US005114077A

United States Patent [19]

Cerny

[11] Patent Number: 5,114,077

[45] Date of Patent: May 19, 1992

[54] FUEL INJECTOR END CAP

[75] Inventor: Mark S. Cerny, Sterling Heights, Mich.

[73] Assignee: Siemens Automotive L.P., Auburn Hills, Mich.

[21] Appl. No.: 626,505

[22] Filed: Dec. 12, 1990

[51] Int. Cl.[5] ..... F02M 63/00

[52] U.S. Cl. ..... 239/483; 239/585.2; 239/585.3; 239/900; 251/129.16

[58] Field of Search ..... 239/585, 533.2, 533.3, 239/478; 251/129.16, 129.15

[56] References Cited

U.S. PATENT DOCUMENTS 4,572,436 2/1986 Stettner et al. ..... 239/585

4,690,373 9/1987 Linder et al. ..... 239/585

4,693,275 9/1987 Stoltman ..... 251/129.16

5,004,154 4/1991 Yoshida et al. ..... 239/585

*Primary Examiner*—Andres Kashnikow

*Assistant Examiner*—Lesley D. Morris

*Attorney, Agent, or Firm*—Russel C. Wells; George L. Boller

[57] ABSTRACT

A metal end cap for a high pressure fuel injector prevents leakage of fuel as a result of high pressures within the injector. The terminals for the solenoid are insulated from the cap by means a plurality of insulating spacers on either side of a high pressure O-ring seal. The metal end cap is sealed by means of a high press O-ring seal from the body of the injector.

5 Claims, 1 Drawing Sheet

FUEL INJECTOR END CAP

FIELD OF INVENTION

This invention relates to high pressure valves in general and more particularly to high pressure fuel injector valves for internal combustion engines.

BACKGROUND OF INVENTION

In working with high pressure fuel injectors wherein the pressure of the fuel exceeds 6.5 Bar, typically over 65 Bar, the materials used in the construction of the major parts of the injector can develop pressure cracks over life which will allow fuel to seep out externally. As can be appreciated the leakage of fuel from an injector will result in very unfavorable fuel economy.

In solenoid operated injectors, the terminals of the solenoid coil are typically brought out of the injector through an end cap. The terminals may be suitable for connection to a connector or may be suitable to receive wire terminals. In either event, the terminals must be insulated from the main body of the injector. This is so since most injectors are fabricated from a metal housing and are located in the engine block or manifold.

With the requirement for insulating the terminals from the housing, many end caps are molded from a plastic material. In low pressure injectors, such plastic materials, either thermoset or thermoplastic materials, solve both the insulating problem and they also are solid enough to be leak proof.

In earlier high pressure injectors, the end caps were likewise fabricated from various thermoset and thermoplastic materials. While these solved the insulating problems, over time, very small cracks developed in the caps through which fuel seeped.

SUMMARY OF INVENTION

In order to solve both the problems of fuel seepage and electrical insulation, a metal end cap having side wall o-ring seals and providing suitable shoulders for locating and holding tubular insulators around the solenoid terminals was developed. Since leakage due to high pressures, about 2000 psi, must be prevented, both close tolerances and high pressure o-rings were employed.

DESCRIPTION OF THE PREFERRED EMBODIMENT

Figure 1:
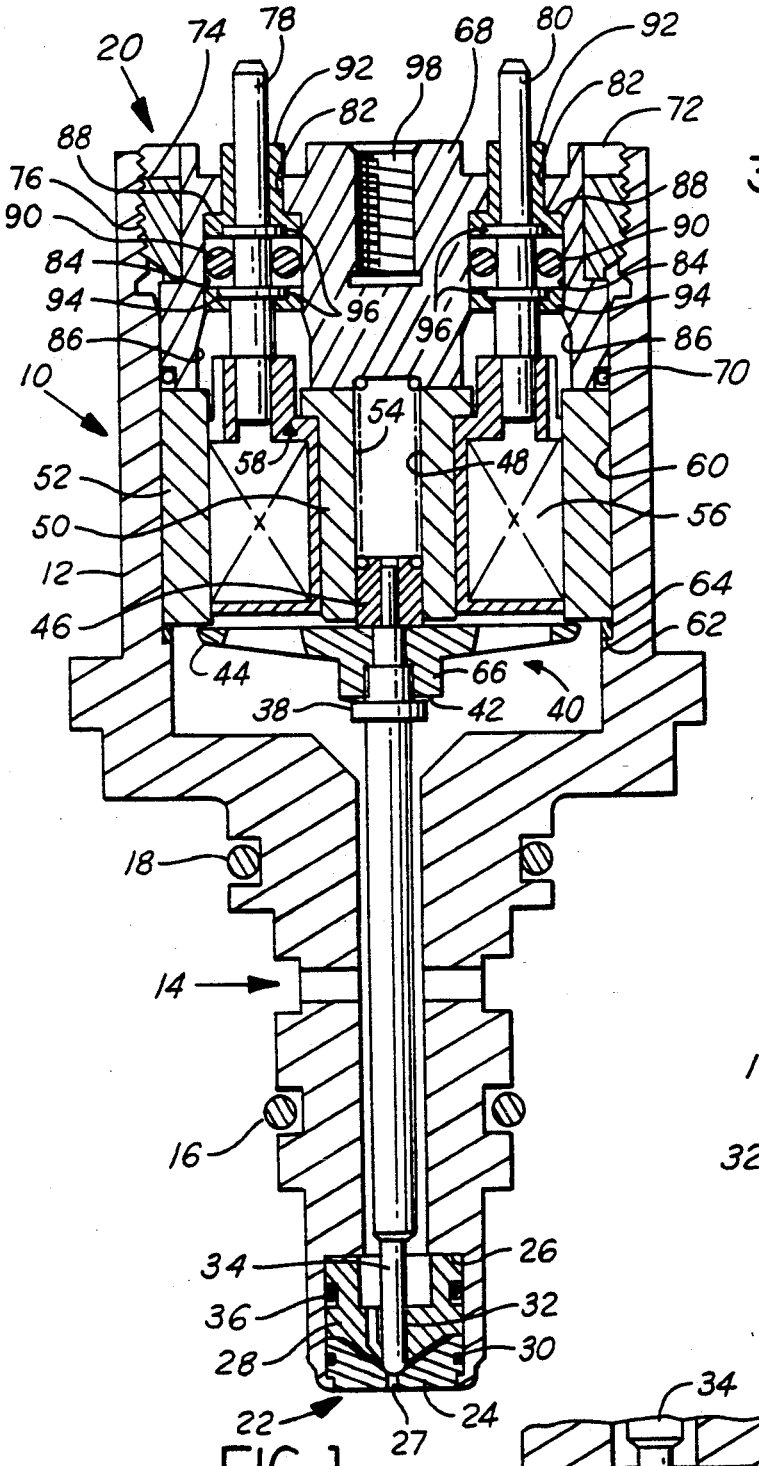
FIG. 1 is a cross section view of a high pressure fuel injector.

Referring to FIG. 1 there is illustrated in cross section, a high pressure injector 10 designed to operate at fuel pressures over 1000 psi. The injector includes a tubular housing member 12 made from nonmagnetic stainless steel. The inside of the tubular housing member 12 has a plurality of different diameters to form different shoulders for different functions as will be hereinafter explained. Positioned along the outside of the housing member 12 and on either side of the inlet 14 are sealing means 16, 18 to seal the injector 10 in the bore of the engine or manifold where it is located. The housing member 12 has an open end 20 and an outlet end 22 enclosing a valve seat 24 containing an orifice 27. The outlet end 22 is counterbored to form a shoulder 26 for locating the valve seat 24 and the spray generator 28.

For clarity, the several sealing means illustrated in the injector are shown as being spaced from the walls surrounding the seals. This, in actual construction and to make the seals operable, can not be so as the seals must be contained so as not to extrude under pressure.

The valve seat 24 is swaged in the housing member 12 for locating the valve seat 24 and the spray generator 28 against the shoulder 26 at the end of the counterbore. The valve seat 24 has a sealing means 30 such as a c-shaped metal seal to prevent leakage of fuel from around the valve seat 24. The c-shaped metal seal 30 is a very high temperature seal which will not break down because of the high temperatures at the outlet end 22 of the injector 10. Adjacent to the valve seat 24 is the spray generator 28 having an axially aligned bore 32 through which reciprocates a needle valve 34. The spray generator 28 has a radial extending seal 36 between itself and the housing member's 12 inner surface.

The needle valve 34 has a spherical radius for mating with the valve seat 24 to close the injector 10. At the end of the needle valve 34 opposite the spherical radius, there is a collar 38 supporting an armature means 40 comprising a damping member 42 and an armature member 44. The armature member 44 is located on the needle valve 34 butting against the damping member 42 and is free to move, ever so slightly, axially along the needle valve 34 against the damping member 42 which may be a belleville washer. The end of the needle valve 34 is received in a spring retainer 46 which is slidably received in a bore 48 in the inner pole 50 of the solenoid core.

The solenoid core is of a circular core configuration, wherein the inner pole 50 is concentric with the outer pole 52 and the pole members are joined at the end opposite the end facing the armature member 44. The cross-sectional areas of the inner 50 and outer poles 52 of the core are substantially equal. The inner pole 50 has the bore 48 extending therethrough for receiving a bias spring 54. In addition, the inner pole 50 is recessed from the plane passing through the ends of the outer pole 52.

Positioned in the space between the inner 50 and outer poles 52 is a coil 56 wound around a bobbin member 58 as shown which is a wet coil construction or may be an completely encapsulated winding or overmolded winding, resulting in a dry coil construction. Wet and dry coil construction refers to whether or not fuel comes in contact with the winding.

The solenoid is located against the inner surface 60 of the tubular housing member 12 between the open end 20 and a shoulder 62 radially extending along the inner surface 60 of the housing member. Positioned against the armature end of the solenoid and the shoulder 62 is a spacing ring 64. As will be seen the spacing ring 64 provides the proper amount of static fuel flow from the injector 10 by limiting the lift of the needle valve 34 to a maximum amount.

The armature member 44 is a circular member having a central hub 66. The armature member 44 extends across the ends of the solenoid core and is of light mass. In order to lighten up the mass of the armature member and not reduce its magnetic function, several openings are provided between the outer peripheral surface of the armature member 44 and its central hub 66. These openings are typically equally spaced along a radius of the armature member 44.

Since the housing member 12 is nonmagnetic, the magnetic lines of flux flow from the coil 56 through the inner pole 50 of the solenoid across the air gap adjacent to the armature member 44, through the armature member to the air gap adjacent the outer pole 52 of the solenoid and back to the coil 56. By recessing the inner pole 50, the closing time of the injector 10 is changed without significantly effecting the opening time of the injector.

The end cap 68 is positioned against the inner surface 60 of the housing member !2 and abuts the one end of the solenoid core. An o-ring 70 is positioned along the outside axial surface of the end cap 68 and between the end cap 68 and the inner surface 60 of the housing member 12 to prevent fluid passing thereby. The end cap 68 is located against the solenoid core by means of a ring 72 having threads 74 along its outside periphery which engage similar threads 76 on the inner surface 60 of the housing member 12 at the open end 20. As the threaded ring 72 is tightened, the end cap 68 bears against the solenoid core 50, 52 which bears against the spacing ring 64 which bears against the shoulder 62 of the housing member 12.

The end cap 68 also functions to enclose the axial bore 48 of the inner pole 50 containing the bias spring 54. The function of the bias spring 54 is to bias the needle valve 34 against the valve seat 24 thereby closing the injector 10. The amount of bias or spring force determines the closing time of the injector and the closing force of the valve needle on the valve seat.

In order to complete the injector 10, a pair of terminals 78, 80 are secured to the ends of the coil 56 and extend through a pair of openings in the end cap 68. Since the terminals 78, 80 are also of an electrically conducting material, they must be insulated from the end cap 68. The openings are each a series of bores and counterbores and in FIG. 1 there is one through bore 82, a counterbore 84 extending from the inside surface of the end cap 68 intermediate the ends of the through bore 82 and a third larger bore 86 extending from the inside surface of the end cap 68 part way axially along the counterbore 84. The function of the counterbore 84 is to form a shoulder 88 to retain the insulating means.

The insulating means functions to insulate the terminals 78, 80 from the end cap 68 and also to secure an o-ring 90 to prevent flow of fuel out of the terminal end. As illustrated the insulating means are two piece tubular members 92, 94 of 30% glass filled nylon each having a central bore and a counterbore extending intermediate its ends. The first tubular member 92 has a radially extending surface forming a surface for abutting the shoulder 88 formed by the counterbore 84 in the end cap 68. The second tubular member 94 has a smooth outer surface which functions to locate the second tubular member 94 in the counterbore 84 of the end cap 68.

Each of the terminals 78, 80 has a pair of spaced apart rings 96 positioned axially along the terminal. Positioned between the rings on the terminal is a sealing means or o-ring 90 to prevent the flow of fuel out along the terminal. The first tubular member 92 of the insulating means encloses the ring 96 nearest the terminal end and extends along the terminal to insulate the terminal from the end cap 68. The second tubular member 94 of the insulating means encloses the second ring 96 and insulates the second ring from the end cap 68. As illustrated, the pressure from within the injector 10 bears against the second tubular member 94 of the insulating means and forces the second tubular member 94 against the ring 96 on the terminal forcing the terminal and the first tubular member 92 against the shoulder 88 formed by the counterbore 84 in the end cap 68.

In the embodiment shown, there is an enclosed threaded hole 98 along the axis of the end cap 68. This hole 98 is capable of receiving a threaded member from a connector which may be used to connect the terminals 78, 80 from the coil to an external circuit. In addition, the threaded hole 98 may also receive a end cap removal member, not shown, which will assist in the removal of the end cap 68 after the threaded ring 72 is removed. This may be necessary to change the bias spring 54, the spacer 64, or for any maintenance which might be necessary to the injector 10.

Figure 2:
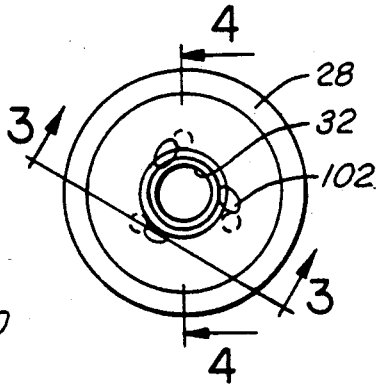
FIG. 2 is a plan view of a spray generator.
Figure 3:
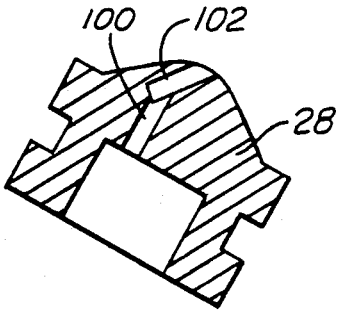
FIG. 3 is a sectional view taken along line 3—3 of FIG. 2.
Figure 4:
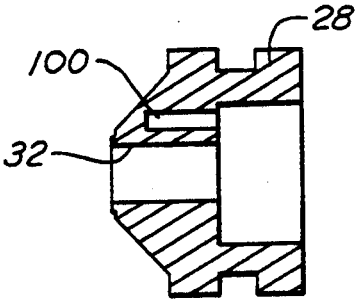
FIG. 4 is a sectional view taken along line 4—4 of FIG. 2.
Figure 5:
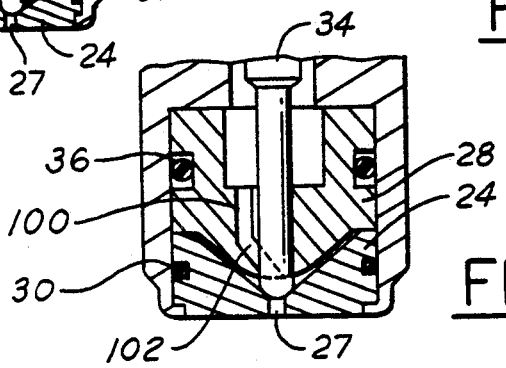
FIG. 5 is an enlarged cross section of the spray generator and valve seat of the injector of FIG. 1.

Referring to FIG. 2 there is illustrated the end of the spray generator 28 showing the arrangement of the swirl means. The swirl means, in the illustrated embodiment, are a plurality of pairs of passageways 100, 102 intersecting each other as shown in FIG. 3. As the fuel flows from the inlet 14 of the housing member 12 toward the outlet end 22 when the valve is open, the fuel flows along the first axially aligned passageway 100, see FIG. 4, and then through the second inclined passageway 102, FIG. 3, which is tangentially inclined to the central bore 32 of the spray generator 28 of the injector 10 to form a swirl pattern. The fuel then flows along the inside surface of the valve seat 24 and out of the orifice 27 of the valve seat 24 as may be seen in FIG. 5. As the fuel leaves the orifice 27, it forms a solid conical spray pattern.

I claim:

1. In a fuel injector having a metallic housing containing a valve seat, a spray generator, a needle valve, an armature, a solenoid having terminals extending from said windings, wherein the improvement comprises:

a metallic end cap member located in the housing and near the solenoid;

insulating means surrounding said terminals providing electrical insulation between the terminals and said metallic end cap member, said insulating means having a first tubular member with a radially extending shoulder adjacent one end and an axially aligned counterbore from said one end extending intermediate the ends and a second tubular member with an axially aligned counterbore from one end extending intermediate the ends; and sealing means located adjacent said insulating means for preventing the flow of fuel from inside said injector.

2. A fuel injector comprising:

a nonmagnetic tubular housing member having an open end, an outlet end, a fuel inlet proximate said outlet end and a shoulder intermediate the ends;

a valve seat member having an axially aligned orifice, said vale seat member located at said outlet end and swaged in said housing;

a needle valve having spherical seat means for seating in said vale seat member;

a spray generator having an axially aligned bore for guiding said needle valve, said spray generator having fluid passages tangentially aligned with respect to said axially aligned bore for imparting a swirling motion to fluid passing therethrough and out of said orifice when said needle valve is off said valve seat;

armature means adjacent to the end of said needle valve opposite said spherically seat means, said armature means including an armature member and a damping means for absorbing the moving of said armature member when said needle valve seats on said valve seat;

solenoid means positioned inside said tubular housing member including a core member of two concentric cores connected at one end opposite said armature end and having equal cross sectional areas and a winding positioned between said concentric cores;

a ring spacer means positioned against said shoulder of said tubular housing means for locating said armature end of said solenoid means in said housing means;

terminal means extending from said winding out of said open end of said tubular housing means;

insulating means positioned around said terminal means, said insulating means including sealing means;

end cap means for receiving said insulating means and said terminal means and adapted to bear against said solenoid means, said end cap means being of a metallic material; and threaded ring means adapted to engage threading means along the inside of said tubular housing member adjacent said open end, said threaded ring means for locating said end cap against said solenoid means against said ring spacer means for making an unitary injector.

3. The fuel injector according to claim 2 wherein said spray generator has a plurality of pairs of fuel passageways wherein one passageway of each pair is parallel to the axis of said spray generator and the second passageway of each pair is tangentially inclined to the axially aligned bore central aperture from the parallelly aligned passageway.

4. The fuel injector according to claim 2 wherein said solenoid means has an axially aligned bore in said inner core and further including bias means located in said bore for biasing said needle valve against said valve seat member.

5. The fuel injector according to claim 2 wherein said insulating means comprises a first tubular member having an radially extending shoulder adjacent one end and an axially aligned counterbore from said one end extending intermediate the ends and a second tubular member having an axially aligned counterbore from one end extending intermediate the ends.

* * * * *